US007824056B2

(12) United States Patent
Madireddi et al.

(10) Patent No.: US 7,824,056 B2
(45) Date of Patent: Nov. 2, 2010

(54) REFRIGERATED MERCHANDISER WITH LED LIGHTING

(75) Inventors: Sesha C. Madireddi, Saint Charles, MO (US); John M. Roche, Ballwin, MO (US)

(73) Assignee: Hussmann Corporation, Bridgeton, MO (US)

( * ) Notice: Subject to any disclaimer, the term of this patent is extended or adjusted under 35 U.S.C. 154(b) by 376 days.

(21) Appl. No.: 11/962,343

(22) Filed: Dec. 21, 2007

(65) Prior Publication Data

US 2008/0158858 A1 Jul. 3, 2008

Related U.S. Application Data

(60) Provisional application No. 60/878,015, filed on Dec. 29, 2006.

(51) Int. Cl.
*A47F 11/10* (2006.01)

(52) U.S. Cl. ..... 362/125; 362/92; 362/218

(58) Field of Classification Search ..... 362/92, 362/125, 126, 218; 312/116, 230; 62/82
See application file for complete search history.

(56) References Cited

U.S. PATENT DOCUMENTS

| | | | |
|---|---|---|---|
| 2,822,672 | A | 2/1958 | Dickson et al. |
| 3,304,740 | A | 2/1967 | Dickson et al. |
| 3,612,848 | A | 10/1971 | Koch et al. |
| 3,986,018 | A | 10/1976 | Ishii |
| 4,000,407 | A | 12/1976 | Keller et al. |
| 4,005,135 | A | 1/1977 | Helding |
| 4,145,893 | A | 3/1979 | Vogel |
| 4,356,540 | A | 10/1982 | Goralnik |
| 4,361,012 | A | 11/1982 | Ibrahim |
| 4,489,995 | A | 12/1984 | Barr |
| 4,544,992 | A | 10/1985 | Cover |
| 4,704,660 | A | 11/1987 | Robbins |
| 4,748,545 | A | 5/1988 | Schmitt |
| 4,825,341 | A | 4/1989 | Awai |
| 4,887,154 | A | 12/1989 | Wawro et al. |
| 4,941,327 | A | 7/1990 | Miles |
| 4,993,561 | A | 2/1991 | Stultz |
| 5,147,130 | A | 9/1992 | Watanuki |

(Continued)

FOREIGN PATENT DOCUMENTS

| | | |
|---|---|---|
| DE | 29717444 | 2/1998 |

(Continued)

*Primary Examiner*—Gunyoung T Lee
(74) *Attorney, Agent, or Firm*—Michael Best & Friedrich LLP

(57) ABSTRACT

A light assembly for a refrigerated merchandiser that includes a case defining a product display area and that has at least one mullion. The light assembly includes a housing that is attachable to the mullion, a specular member that is coupled to the housing within a first receiving portion, and a LED light source that is coupled to the housing within a second receiving portion substantially opposite the specular member. The LED light source includes a first light portion and a second light portion that are directed along at least one illumination path. The first light portion is directed along the illumination path in a first direction directly toward the product display area, and the second light portion is directed along the illumination path toward the specular member. The second light portion is reflected by the specular member in a second direction at least partially opposite the first direction.

18 Claims, 5 Drawing Sheets

U.S. PATENT DOCUMENTS 5,172,973 A 12/1992 Spada
5,269,231 A 12/1993 Johnson
5,283,721 A 2/1994 Powell
5,301,092 A 4/1994 Santosuosso et al.
5,321,595 A 6/1994 Jacobi et al.
5,341,275 A 8/1994 Ghandehari
5,381,320 A 1/1995 Jordan
5,471,372 A * 11/1995 Mamelson et al. ..... 362/92
5,508,898 A 4/1996 McGovern
5,517,826 A 5/1996 Duffy
5,626,028 A 5/1997 Graat et al.
5,658,067 A 8/1997 Engle et al.
5,690,415 A 11/1997 Krehl
5,785,585 A 7/1998 Manfredi et al.
5,902,034 A 5/1999 Santosuosso et al.
6,179,434 B1 1/2001 Saraiji
6,558,017 B1 5/2003 Saraiji et al.
6,578,978 B1 6/2003 Upton et al.
6,641,283 B1 11/2003 Bohler
6,827,463 B2 12/2004 Chuang et al.
6,880,949 B2 4/2005 Miozza et al.
7,036,947 B2 5/2006 Chuang et al.
7,121,675 B2 10/2006 Ter-Hovhannisian
7,145,179 B2 12/2006 Petroski
7,170,751 B2 1/2007 Mayer
7,281,816 B2 * 10/2007 Suzuki ..... 362/231
7,513,637 B2 * 4/2009 Kelly et al. ..... 362/126
2003/0179548 A1 9/2003 Becker et al.
2005/0265019 A1 12/2005 Sommers et al.
2006/0061999 A1 3/2006 Sommers et al.
2007/0247835 A1 * 10/2007 Buelow et al. ..... 362/125

FOREIGN PATENT DOCUMENTS

EP 0971186 6/1999

* cited by examiner

REFRIGERATED MERCHANDISER WITH LED LIGHTING

RELATED APPLICATIONS

This patent application claims priority to U.S. Patent Application Ser. No. 60/878,015, filed Dec. 29, 2006, the entire contents of which are hereby incorporated by reference.

BACKGROUND

The present invention relates to a refrigerated merchandiser that includes a light source. More particularly, the present invention relates to a refrigerated merchandiser including a light emitting diode (LED) light source to illuminate a product display area.

In conventional practice, commercial businesses such as supermarkets and convenience stores are equipped with refrigerated merchandisers. These refrigerated merchandisers may be open or provided with doors and are used for presenting perishable food or beverages to customers while maintaining the fresh food or beverages in a refrigerated environment. Typically, these refrigerated merchandisers include a light source to illuminate the product display area for better marketing of the food product and for higher visibility to the customers.

Conventional refrigerated merchandisers typically include a fluorescent light source to illuminate the product display area. Some refrigerated merchandisers include fluorescent light sources coupled to a canopy of the refrigerated merchandiser to direct light generally downward onto the food product in the product display area. These refrigerated merchandisers also may include fluorescent light sources attached to shelves in the product display area. Generally, the fluorescent light sources used in conventional refrigerated merchandisers are relatively large, and can reduce the amount of space in the refrigerated merchandiser that can be allocated to displaying food product.

The effectiveness of fluorescent light sources is dependent on the temperature of the application where the fluorescent light sources are used. In colder temperature conditions, the fluorescent light source has less light output than in application of the fluorescent light source in warmer temperature conditions. As a result, fluorescent light sources that are coupled to the shelves can have substantially reduced effective illumination of food product within the product display area.

Some refrigerated merchandisers include light emitting diode (LED) light sources to illuminate the product display area. These LED light sources generally operate at a relatively high current (e.g., 300 mA), which produces a substantial amount of heat that can adversely affect the temperature of the food product in the product display area. The large amount of heat produced by these LED light sources can adversely affect the effective life of the light source.

Replacing light sources in existing refrigerated merchandisers can be relatively complex and inefficient. Generally, refrigerated merchandisers must be modified to accommodate a replacement light source from a different manufacturer. Often, additional holes are needed in the existing canopy and/or shelves to adapt the existing refrigerated merchandiser to the replacement light source, which can increase the complexity of the assembly process and the time needed to replace the light source.

SUMMARY

The invention provides an improved refrigerated merchandiser configured to illuminate a product display area effectively and efficiently. In one embodiment, the invention provides an improved light source that enables improved illumination of the product display area and reduces the energy required to refrigerate the products within the refrigerated merchandiser.

In another embodiment, the invention provides a light assembly for a refrigerated merchandiser that includes a case that defines a product display area for supporting product and that has at least one mullion. The light assembly includes a housing that is attachable to the mullion and that includes a first receiving portion and a second receiving portion that is spaced apart from the first receiving portion. The light assembly includes at least one specular member that is coupled to the housing within the first receiving portion, and a LED light source that is coupled to the housing within the second receiving portion substantially opposite the specular member. The LED light source includes a first light portion and a second light portion directed along at least one illumination path. The first light portion is directed along the at least one illumination path in a first direction directly toward the product display area, and the second light portion is directed along the at least one illumination path toward the specular member and reflected by the specular member in a second direction that is at least partially opposite the first direction.

In yet another embodiment, the invention provides a refrigerated merchandiser that includes a case that defines a product display area, and that has at least one shelf for supporting product in the product display area. The refrigerated merchandiser also includes a price tag molding that is coupled to a front of the shelf and that displays information related to the product supported on the shelf. The refrigerated merchandiser further includes a light assembly that is positioned under the shelf adjacent and behind the price tag molding when viewed from outside the case. The light assembly is substantially hidden from view by the price tag molding, and includes a housing that extends along a substantial width of the shelf and that has a light receiving portion. The light assembly also has at least one LED light source, a first specular member, and a second specular member. The LED light source is coupled to the housing within the light receiving portion to direct light generally toward the product display area. Each of the first specular member and the second specular member is coupled to the housing and located adjacent the LED light source to reflect a portion of the light from the LED light source toward the product display area. The refrigerated merchandiser further includes a magnet that is coupled to the housing opposite the LED light source and that extends along a substantial length of the housing to attach the light assembly to the shelf.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
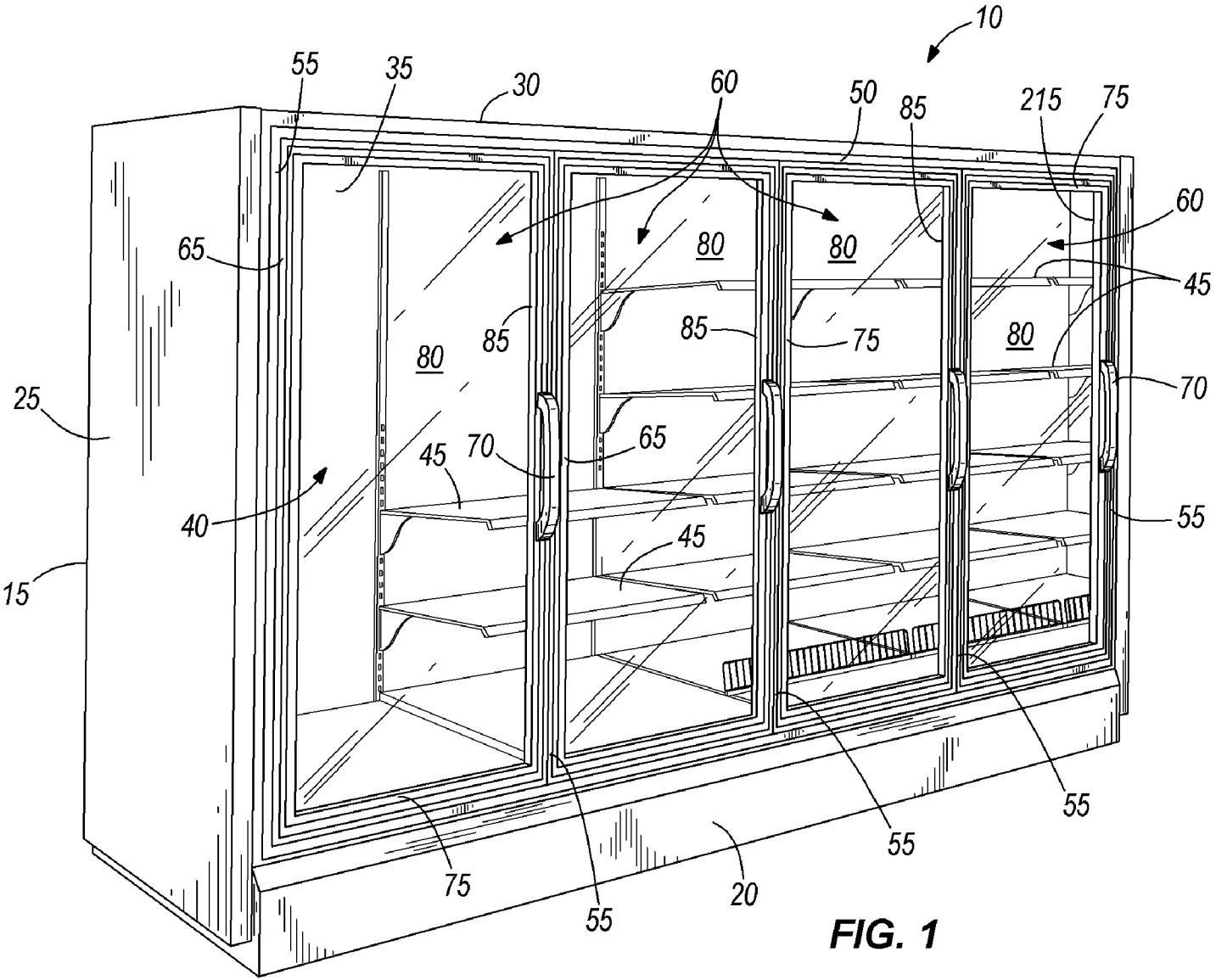
FIG. 1 is a perspective view of an exemplary refrigerated merchandiser.

FIG. 1 shows a refrigerated merchandiser 10 for displaying food product (e.g., frozen food, fresh food, beverages, etc.) available to consumers in a retail setting (e.g., a supermarket or grocery store). The refrigerated merchandiser 10 includes a case 15 that has a base 20, side walls 25, a case top or canopy 30, and a rear wall 35. At least a portion of a refrigeration system (not shown) can be located within the case 15 to refrigerate the food product. The area partially enclosed by the base 20, the side walls 25, the case top 30, and the rear wall 35 defines a product display area 40. The food product is supported on shelves 45 within the product display area 40. Generally, at least a portion of the shelves 45 are constructed of a metallic material (e.g., steel).

In some embodiments, the case 15 includes a casing 50 adjacent a front of the merchandiser 10. FIG. 1 shows that the casing 50 includes vertical mullions 55 that define openings 60, and doors 65 positioned over the openings 60. The openings 60 and the doors 65 are configured to allow access to food product stored in the product display area 40. The mullions 55 are spaced horizontally along the case 15 to provide structural support for the case 15. Each mullion 55 is defined by a structural member that can be formed from a non-metallic or metallic material. A handle 70 is positioned along an edge of each door 65 to move the door 65 between an open position and a closed position.

Each door 65 includes a frame 75 that attaches a translucent member 80 to the door 65 to allow viewing of the food product from outside the case 15. The translucent member 80 can be formed from glass, or alternatively, from other materials that are substantially translucent (e.g., acrylic, etc.). In some embodiments, the case 15 can include doors 65 without attachment of the doors 65 to mullions 55. In still other embodiments, the case 15 can be an open-front case without the mullions 55 and doors 65.

Figure 2:
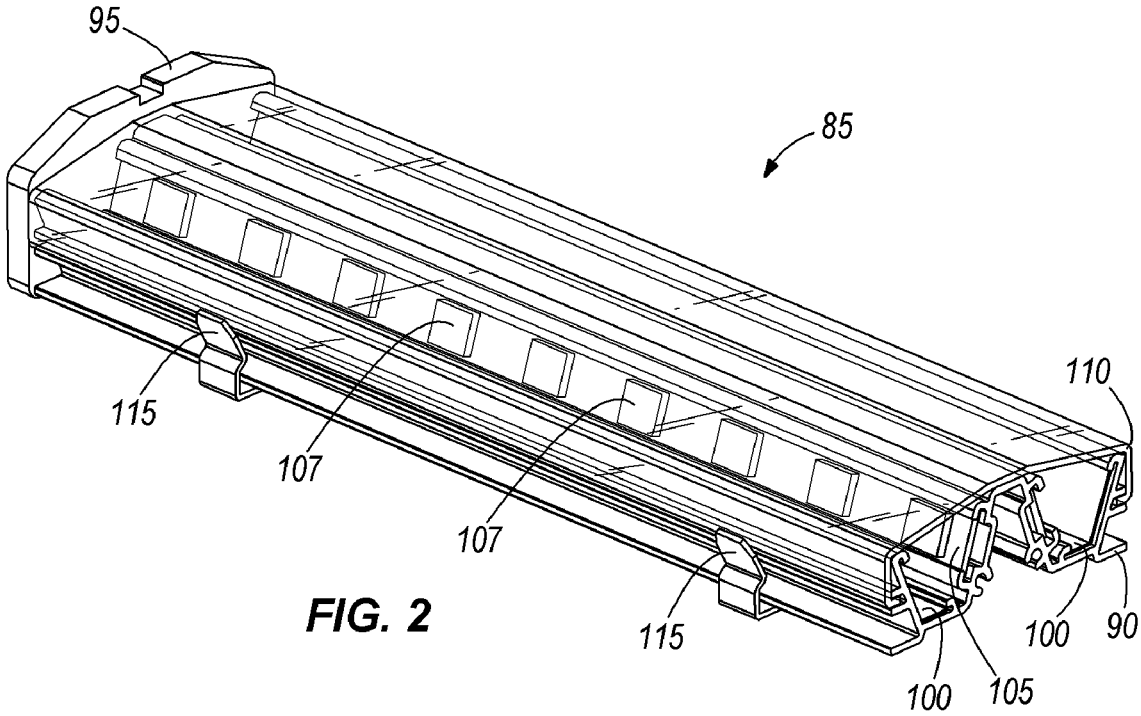
FIG. 2 is a perspective view of a mullion light assembly of the refrigerated merchandiser of FIG. 1, including a housing and an LED light source.
Figure 3:
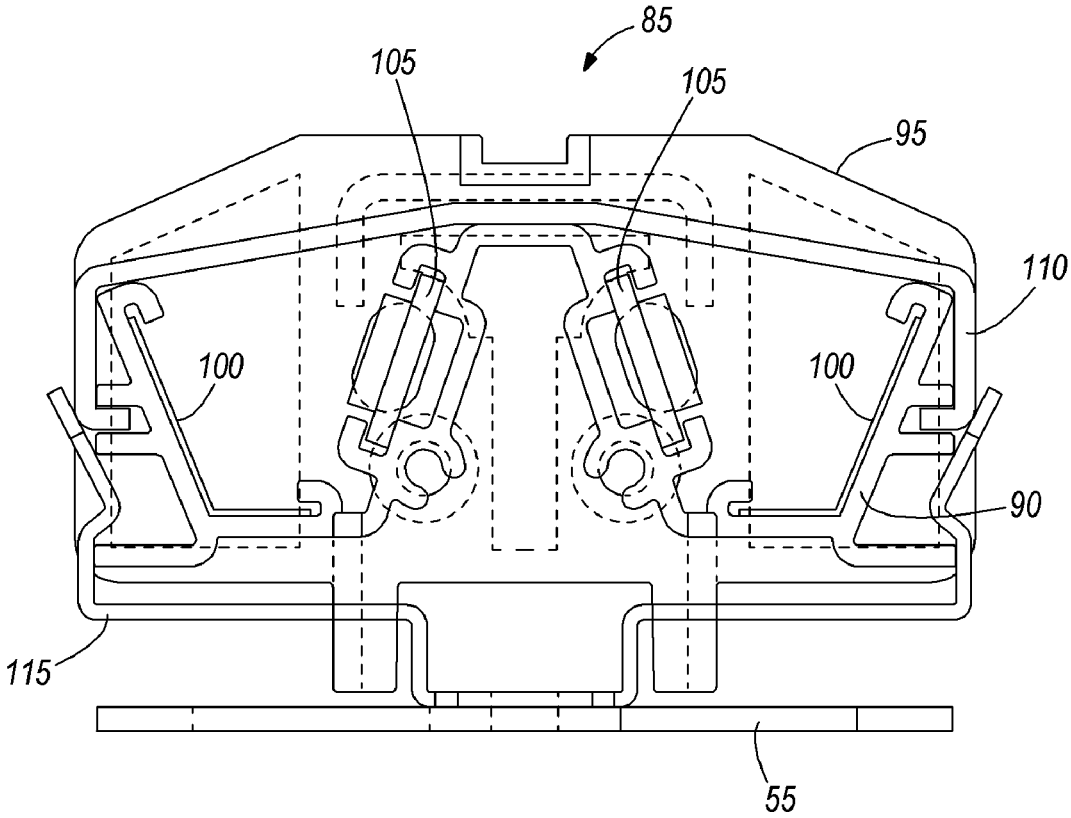
FIG. 3 is an end view of the mullion light assembly of FIG. 2.
Figure 4:
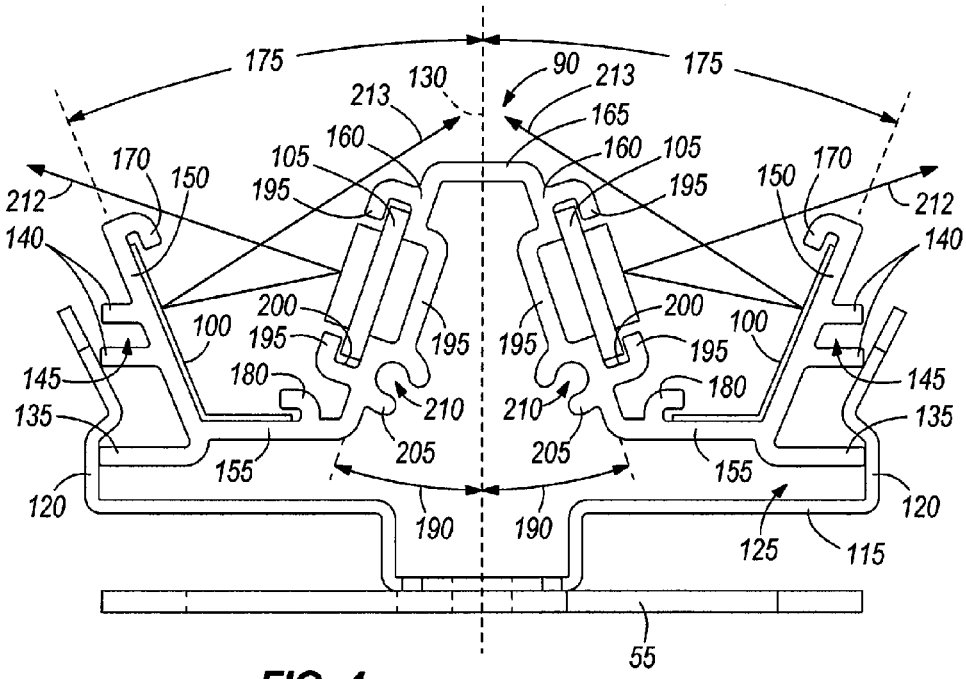
FIG. 4 is an end view of the housing and the LED light source of FIG. 3.

FIGS. 2 and 3 show a mullion light assembly 85 that can be attached to each mullion 55 of the case 15 to illuminate the product display area 40. The mullion light assembly 85 includes a housing or shell 90, end caps 95, mirrors or specular members 100, light emitting diode (LED) light sources 105, and a translucent cover or lens 110 attached to the housing 90 to protect the LED light source 105 from debris or incidental contact. The housing 90 can be attached to each mullion 55 using clips 115 or other similar fasteners. As shown in FIGS. 3 and 4, the clips 115 are bent members coupled to the interior side of each mullion 55 using fasteners (e.g., screws, bolts, etc.). Each clip 115 includes sidewalls 120 that define a recess 125 configured to receive the housing 90.

FIG. 4 shows the housing 90 defined by a generally W-shaped extruded body formed from a high-impact material that is resistant to breakage. A plane 130 passes through a middle of the mullion light assembly 85 substantially perpendicularly through the housing 90, and divides the light assembly 85 into a left-hand portion and a right-hand portion. As illustrated in FIG. 4, the left-hand portion is substantially a mirror image of the right-hand portion. The housing 90 extends along a substantial length of each mullion 55, and is generally symmetrical about the plane 130. The housing 90 includes clip members 135 that extend from sides of the extruded body to couple the housing 90 to the sidewalls 120 of each clip 115. The housing 90 also includes a generally parallel attachment portion 140 on each side of the extruded body that defines a channel 145 to attach a respective end of the translucent cover 110 to the housing 90.

The W-shaped housing is defined by end walls 150, middle walls 155, interior walls 160, and a bridge 165 that connects the interior walls 160 to each other. The end walls 150 extend generally outward from the middle wall 155 to obscure visibility of the LED light sources 105 from outside the merchandiser 10, and include first receiving portions 170 defined on an end of the end walls 150. Each end wall 150 is angularly spaced from one middle wall 155, and is further disposed at a first angle 175 from the plane 130. In the illustrated embodiment, the first angle 175 is about 20 degrees. In other embodiments, the first angle 175 can be larger or smaller than 20 degrees.

Each middle wall 155 is oriented horizontally and perpendicular to the plane 130, and includes a second receiving portion 180 that is formed as part of the extruded body. The interior walls 160 are angularly spaced from the middle walls 155 and the bridge 165, and define a second angle 190 relative to the plane 130. In the illustrated embodiment, the second angle 190 is about 20 degrees. In other embodiments, the second angle 190 can be larger or smaller than 20 degrees. Each interior wall 160 includes light receiving portions 195 formed as part of the extruded body that cooperate to define a stepped-recess 200.

The housing 90 further includes extruded members 205 that define channels 210 located on the extruded body adjacent to and on an opposite side from the light receiving portions 195. The end caps 95 are attached to the housing 90 within the channels 210 to cover the ends of the housing 90. The end caps 95 limit accumulation of debris on the mirrors 100 and LED light sources 105, and are removable from the housing 90.

The mirrors 100 and the LED light sources 105 are generally directed at food product in the product display area 40. FIG. 4 shows that each mirror 100 is attached to the housing 90 within the first and second receiving portions 170, 180, and includes a reflective material (e.g., polished aluminum, polished stainless steel, chrome-plated steel, metalized polymer tape, etc.) to reflect light from the LED light source 105 into the product display area 40 without loss of luminescence. Generally, the reflectance capacity of the mirrors 100 is above about 70 percent reflectance to reflect a substantial amount of light from the LED light source 105 into the product display area 40.

Each mirror 100 extends a substantial length of the mullion light assembly 85, and is bent to conform to the angular spacing between the end wall 150 and the middle wall 155. One end of each mirror 100 is engaged with the end wall 150 within the first receiving portion 170, and another end of each mirror 100 is engaged with the middle wall 155 within the second receiving portion 180. The illustrated mirrors 100 are substantially flat mirror surfaces that are bent to conform to the bend in the W-shaped housing 90. In some embodiments, the mirrors 100 can be rounded mirror surfaces (not shown) positioned in the housing 90 to reflect light into the product display area 40.

Each LED light source 105 is in electrical communication with the case 15 through the mullion 55. The LED light sources 105 are coupled to circuit boards that dissipate heat from the LED light sources 105, and eliminate the need for a heat sink coupled to the LED light sources 105. The circuit boards are made from conventional printed circuit board material without being metal clad, and without an aluminum heat sink. Power is supplied to the LED light sources 105 from a power supply (not shown).

As illustrated in FIG. 2, the LED light source 105 includes LED packages 107 spaced at predetermined distances along the housing 90. For example, the LED packages 107 can be defined by an area of about 0.5 inches by 0.5 inches. Each LED package 107 can include any number of LEDs. In some embodiments, each LED package 107 can include six LEDs. In other embodiments, each LED package 107 may include fewer or more than six LEDs. The LEDs in each LED package 107 are low current LEDs (e.g., 15 mA), and the quantity of the LEDs are determined by the lighting necessary to illuminate the product display area 40.

FIG. 4 shows that the LED light sources 105 are attached to the housing 90 within the light receiving portions 195. The LED light source 105 that is attached to the interior wall 160 on the left of the plane 130 (as viewed in FIGS. 3 and 4) is directed in a first direction away from the mullion 55 (i.e., generally toward the product display area 40 on the left of the mullion 55). The LED light source 105 that is attached to the interior wall 160 on the right of the plane 130 (as viewed in FIGS. 3 and 4) is directed in a second direction that is symmetrically opposite the first direction (i.e., generally toward the product display area 40 on the right of the mullion 55). Generally, a portion of the light from each LED light source 105 is aimed directly at the product display area 40, and another portion of the light is directed at the corresponding mirror 100, where the light is reflected into the product display area 40. In other words, a first portion of light 212 of the LED light source 105 is directed along a first illumination path into the product display area, and a second portion of light 213 of the LED light source 105 is directed along a second illumination path that is different from the first illumination path after the second light portion 213 is reflected by the mirror 100. Thus, the mirror 100 and the LED light source 105 cooperate to define a multi-directional light assembly 85.

Figure 5:
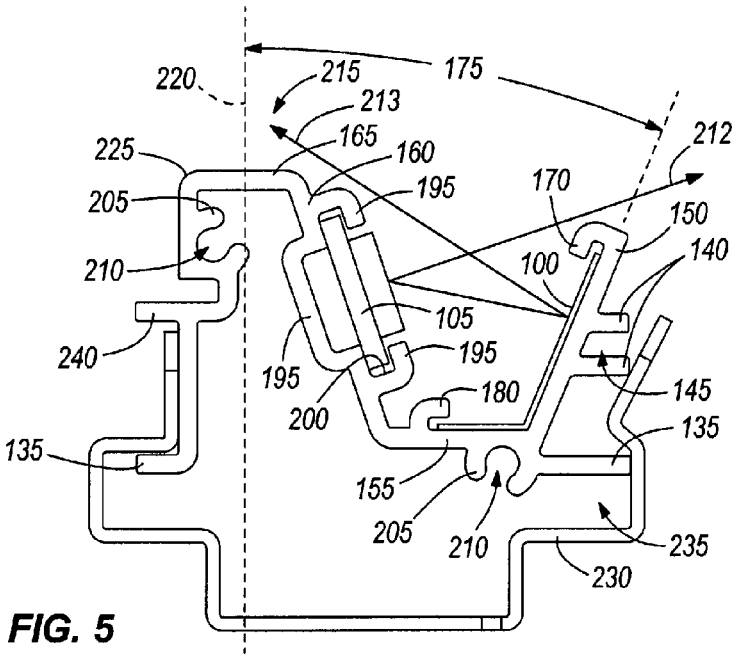
FIG. 5 is an end view of a housing and LED light source of another mullion light assembly of the refrigerated merchandiser of FIG. 1.

FIG. 5 shows another embodiment of a mullion light assembly 215 that can be used on the merchandiser 10 adjacent an end of the case 15. Except as described below, the mullion light assembly 215 is similar to the mullion light assembly 85 described with regard to FIGS. 2-4, and common elements are given the same reference numerals. As illustrated in FIG. 5, a plane 220 divides the mullion light assembly 215 into a right-hand portion and a left-hand portion.

The mullion light assembly 215 includes the mirror 100, the LED light source 105, a housing 225, and a translucent cover (not shown) that can be attached to the housing 225. FIG. 5 shows that the housing 225 is defined by an extruded body that can be attached to the interior side of each end mullion 55 using clips 230 that are bent to conform to the shape of the housing 225. The housing 225 is disposed within a recess 235 defined by the clip 230.

The right-hand portion of the mullion light assembly 215 is generally the same as the right-hand portion of the mullion light assembly 85 described with regard to FIG. 4. Specifically, the right-hand portion of the housing 225 is substantially similar to the right-hand portion of the housing 90, except that the extruded members 205 are located in different positions. For example, one extruded member 205 is positioned adjacent to and below the transition between the end wall 150 and the middle wall 155 on the right-hand portion of the housing 225. The other extruded member 205 is located adjacent the bridge 165 on the left-hand portion. The extruded members 205 can be located anywhere on the housing 225 as long as end caps (not shown) can be attached to the ends of the housing 225. The left-hand portion of the housing 225 further defines a second attachment portion 240 that cooperates with the attachment portion 140 defined on the opposite side of the housing 225 to attach the translucent cover to the housing 225.

The mirror 100 is attached to the housing within the first and second receiving portions 170, 180, and is located only on one side of the housing 225 due to the mullion light assembly 215 being located on the end of the case 15. The LED light source 105 is attached to the housing 225 within the light receiving portion 195, and the first portion of light 212 from the LED light source 105 is aimed directly at the product display area 40. The second portion of light 213 from the LED light source 105 is directed at the mirror 100, where light 213 is reflected into the product display area 40.

Figure 6:
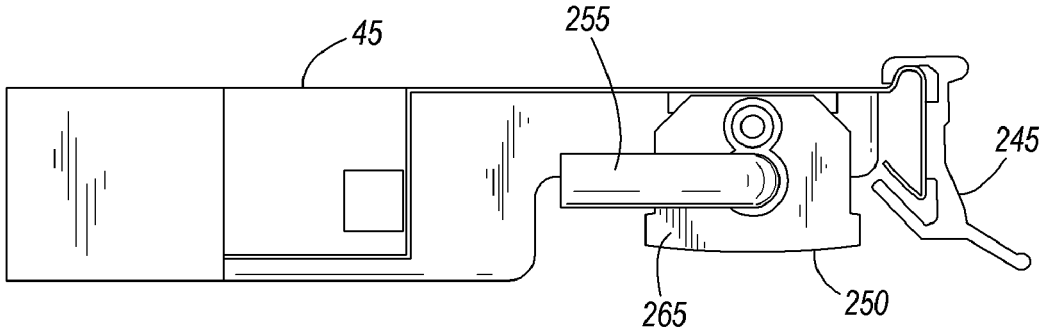
FIG. 6 is a side view of a portion of a shelf of the refrigerated merchandiser of FIG. 1, including a shelf light assembly.

FIG. 6 shows a portion of one shelf 45 of the refrigerated merchandiser 10 that includes a price tag molding 245 and a shelf light assembly 250. The price tag molding 245 is coupled to a front of the shelf 45, and generally displays information related to the food product (e.g., price, description, etc.). The shelf light assembly 250 is positioned under the shelf 45 adjacent to and behind the price tag molding 245 when viewed from outside the case 15. The shelf light assembly 250 is generally or substantially hidden from view by the price tag molding 245. In some embodiments, the shelf light assembly 250 also can be attached to the canopy 30 adjacent a front of the case 15.

Figure 7:
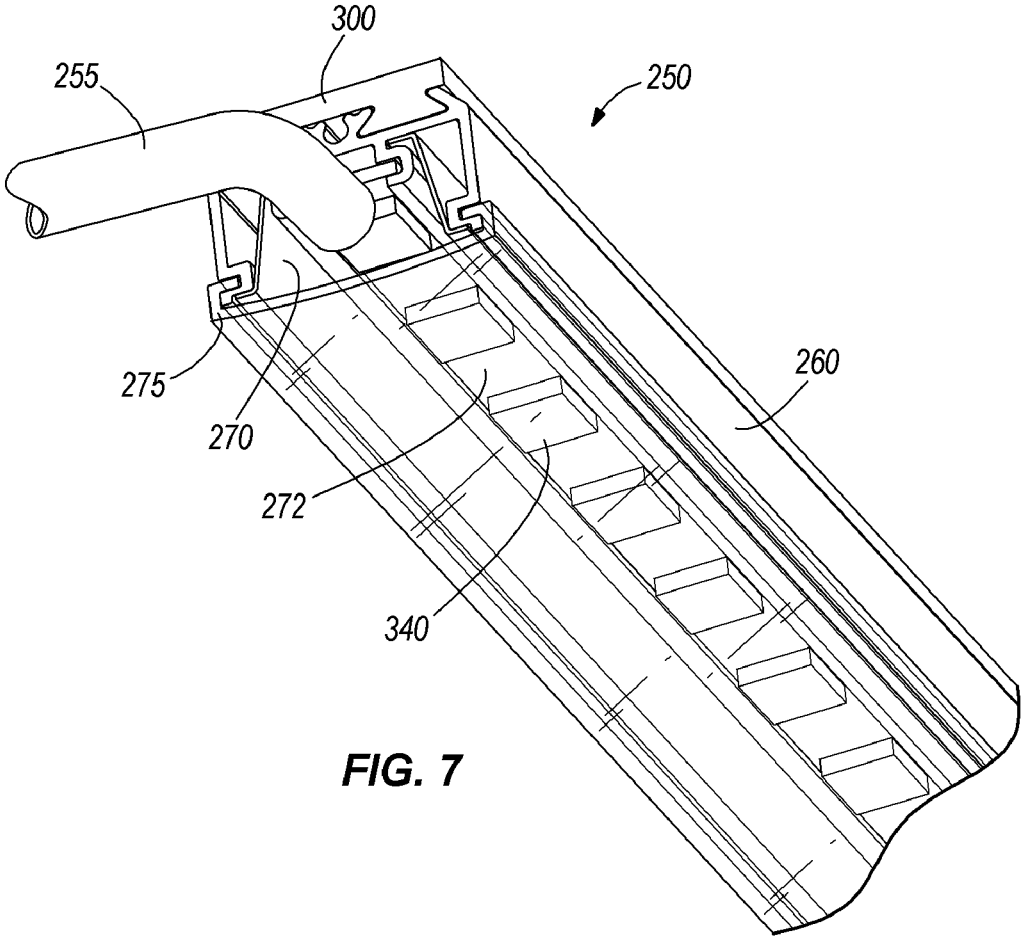
FIG. 7 is a perspective view of the shelf light assembly of FIG. 6, including a housing and an LED light source.

FIGS. 6 and 7 show that the shelf light assembly 250 is in electrical communication with the refrigerated merchandiser 10 via a power conduit 255 coupled to the power supply. The power conduit 255 extends from a back of the product display area 40 toward the shelf light assembly 250. In some embodiments, the power supply is a remote power supply that lowers heat dissipation inside the case 15. In these embodiments, a two-pin plug connection can be used on the shelf 45 to provide a connection for the shelf light assembly 250 to the power supply.

Figure 8:
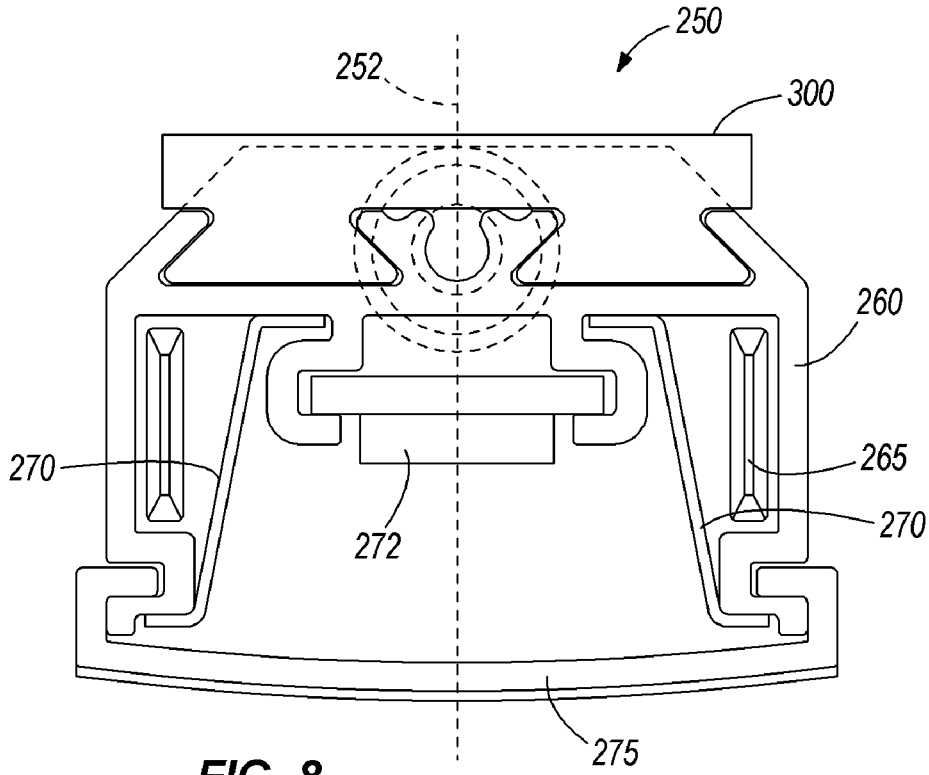
FIG. 8 is an end view of the shelf light assembly of FIG. 7.

FIGS. 7 and 8 show that the shelf light assembly 250 is generally symmetrical about a plane 252, and includes a housing 260, end caps 265, mirrors or specular members 270, an LED light source 272, and a translucent cover 275 attached to the housing 260 to substantially enclose the LED light source 272. The housing 260 extends along a substantial width of each shelf 45 to adequately illuminate food product stored in the product display area 40 below the respective shelf 45.

The housing 260 is defined by a generally U-shaped extruded body formed from a high-impact material, and is symmetrical about the plane 252. The housing 260 includes extruded interior flanges 280 and exterior flanges 285 disposed on a side of the extruded body opposite the side of the LED light source 272. The interior flanges 280 cooperate with each other to define a groove 290 that attaches the end caps 265 to the housing 260. Each exterior flange 285 cooperates with one interior flange 280 to define a channel 295. A magnet 300 extends the length of the housing 260, and is attached to the housing 260 within the channels 295 to magnetically couple the shelf light assembly 250 to the shelf 45. In other embodiments, clips or other fasteners (not shown) may be used to attach the shelf light assembly 250 to the shelves 45.

Figure 9:
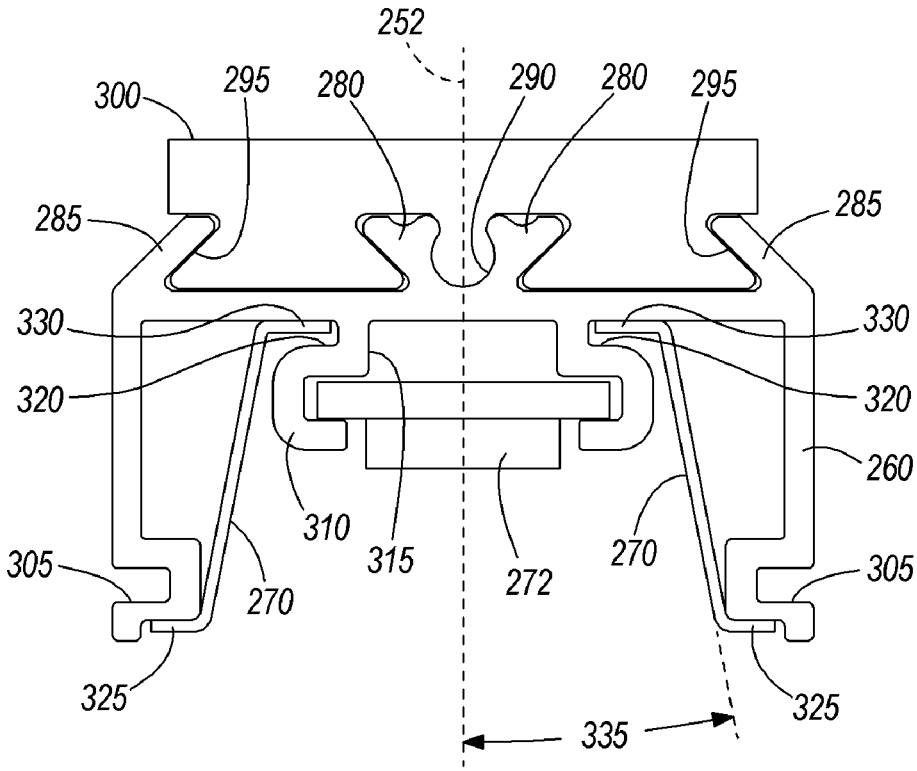
FIG. 9 is an end view of the housing and the LED light source of FIG. 7.

FIGS. 8 and 9 show that the housing 260 further defines a recess 305 adjacent each end of the U-shaped extruded body, and a light receiving portion 310 adjacent a middle portion of the extruded body. The translucent cover 275 is attached to the housing 260 within the recesses 305. The light receiving portion 310 includes symmetrically opposed extruded members that define a stepped recess 315 and exterior grooves 320.

The mirrors 270 include a reflective material (e.g., polished aluminum, polished stainless steel, chrome-plated steel, metalized polymer tape, etc.) to reflect light from the LED light source 272 into the product display area 40. The mirrors 270 are similar to the mirrors 100, and have a reflectance capacity that is above about 70 percent reflectance to reflect a substantial amount of light from the LED light source 272 into the product display area 40.

Each mirror 270 includes a first bent end 325 attached to an end of the housing 260 adjacent the translucent cover 275, and a second bent end 330 engaged with the exterior groove 320. The mirrors 270 are positioned in the housing 260 such that a middle portion of each mirror 270 is disposed at an angle 335 relative to the plane 252. The middle portion of the mirrors 270 are substantially flat to reflect light from the LED light source 272 into the product display area 40. In the illustrated embodiment, the angle 335 is about 20 degrees. In other embodiments, the angle 335 can be more or less than 20 degrees. In some embodiments, the middle portion of the mirrors 270 can include rounded surfaces (not shown).

The LED light source 272 is generally directed at food product in the product display area 40, and is coupled to the housing 260 within the stepped recess 315. The LED light source 272 includes LED packages 340 (FIG. 7) that have low current LEDs (e.g., 15 mA). The quantity of LEDs in each LED package 340 is determined by the lighting necessary to illuminate the product display area 40. The LED light source 272 is similar to the LED light sources 105 of the mullion light assembly 85, and will not be discussed in detail.

In operation, the opposed, multi-directional mullion light assembly 85 uniformly illuminates the product display area 40 while being substantially hidden from view. The first portion of light 212 directed from the LED light source 105 coupled to the left-hand interior wall directly illuminates the product display area 40 to the left of the mullion 55. The second portion of light 213 directed from this LED light source 105 is reflected by the mirror 100 in a direction opposite the direction of the first portion of light 212 generally toward the product display area 40 to the right of the mullion 55. Similarly, the first portion of light 212 directed from the LED light source 105 coupled to the right-hand interior wall directly illuminates the product display area 40 to the right of the mullion 55. The second portion of light 213 directed from this LED light source 105 is reflected by the mirror 100 in a direction opposite the direction of the first portion of light 212, generally toward the product display area 40 to the left of the mullion 55.

The shelf light assembly 250 generally takes up a relatively small area under the shelf 45, and provides a relatively large space between the shelf 45 (to which the shelf light assembly 250 is attached) and the shelf 45 directly below the light assembly 250 for improved viewability of the food product stored therein. The magnet 300 provides relatively quick attachment of the shelf light assembly 250 to the underside of the shelf 45 without use of additional fasteners and without complicated work processes.

The LED light source 272 directs light generally downward toward the product display area 40, and a substantial amount of light from the LED light source 272 is directed at the food product without being reflected by the mirrors 270. However, some light from the LED light source 272 may be directed toward the mirrors 270, which is reflected by the mirrors 270 toward the product display area 40.

The mullion light assemblies 85, 265, and the shelf light assembly 250 can be used together or separately in the refrigerated merchandiser 10 to illuminate the product display area 40. Use of the low current LED packages 107, 340 in each light assembly 85, 215, 250 provides substantial energy savings. Generally, the overall power required to illuminate and to refrigerate the case 15 using the LED light sources 105, 272 is lower than the power required by cases that use fluorescent light sources or high current LED light sources. The low current LED light assemblies 85, 215, 250 also can be used to replace existing fluorescent and high current LED light assemblies of existing merchandisers to provide similar illumination of the product display area 40 via more economical means.

Various features and advantages of the invention are set forth in the following claims.

What is claimed is:

1. A light assembly for a refrigerated merchandiser including a case defining a product display area adapted to support product and having at least one mullion, the light assembly comprising:

a housing attachable to the mullion and including an end wall at least partially defining a first receiving portion of the housing, and an interior wall defining a second receiving portion of the housing spaced apart from the first receiving portion;

a specular member coupled to the end wall within the first receiving portion; and a light emitting diode ("LED") light source coupled to the interior wall within the second receiving portion substantially opposite the specular member, the LED light source including a first light portion and a second light portion directed along at least one illumination path, the first light portion directed along the at least one illumination path in a first direction directly toward the product display area, and the second light portion directed along the at least one illumination path toward the specular member and reflected by the specular member in a second direction at least partially opposite the first direction.

2. The light assembly of claim 1, wherein the housing further includes a first portion and a second portion positioned adjacent the first portion, the first portion and the second portion substantially symmetrical about a plane extending through the housing, each of the first portion and the second portion having one first receiving portion and one second receiving portion spaced apart from the associated first receiving portion.

3. The light assembly of claim 2, wherein the housing is defined by an extruded body having a substantially "W"-shaped cross section.

4. The light assembly of claim 2, wherein the specular member is a first specular member coupled to the housing within the first receiving portion of the first portion, and wherein the LED light source is a first LED light source coupled to the housing within the second receiving portion of the first portion and located substantially opposite the first specular member, further comprising a second specular member coupled to the housing within the first receiving portion of the second portion, and a second LED light source coupled to the housing within the second receiving portion of the second portion and located substantially opposite the second specular member.

5. The light assembly of claim 4, wherein the first LED light source is directed in a first direction, and wherein the second LED light source is directed in a second direction symmetrically opposite the first direction relative to the plane.

6. The light assembly of claim 4, wherein each of the first LED light source and the second LED light source includes a first light portion directed along a first illumination path directly toward the product display area when the housing is attached to the mullion, and a second light portion directed toward the associated specular member and reflected by the associated specular member toward the product display area along a second illumination path that is different from the first illumination path.

7. The light assembly of claim 6, wherein the second illumination path is different from the first illumination path after the second light portion is reflected by the associated specular member.

8. The light assembly of claim 1, wherein the specular member includes a reflectance capacity above about 70 percent reflectance.

9. The light assembly of claim 1, wherein the end wall defines a first non-zero angle relative to a plane extending substantially perpendicularly through the housing.

10. The light assembly of claim 9, wherein the interior wall defines a second non-zero angle relative to the plane extending substantially perpendicularly through the housing.

11. The light assembly of claim 10, wherein the first non-zero angle is about 20 degrees.

12. The light assembly of claim 11, wherein the second non-zero angle is about 20 degrees.

13. The light assembly of claim 1, wherein the housing further includes a middle wall interconnecting the end wall and the interior wall, and wherein the end wall extends outward from the middle wall to obscure visibility of the LED light source from outside the case.

14. The light assembly of claim 13, wherein the end wall is angularly spaced from the middle wall, wherein the end wall and the middle wall cooperate to define the first receiving portion, and wherein the specular member is bent to conform to the angular spacing between the end wall and the middle wall.

15. The light assembly of claim 1, wherein the housing extends along a substantial length of the mullion when the housing is attached to the mullion.

16. The light assembly of claim 1, wherein the specular member extends along a substantial length of the housing.

17. The light assembly of claim 1, further comprising at least one of an end cap and a cover attached to the housing, wherein the end cap and the cover limit accumulation of debris on the specular member and the LED light source.

18. The light assembly of claim 1, wherein the LED light source includes a plurality of LED packages spaced at a predetermined distance along a length of the housing.

* * * * *